US009694927B2

(12) United States Patent
Smith

(10) Patent No.: US 9,694,927 B2
(45) Date of Patent: Jul. 4, 2017

(54) BRACKET FOR SECURING A BAG IN A SHIPPING CONTAINER AND METHOD OF USE

(71) Applicant: Gary D Smith, Parker, CO (US)

(72) Inventor: Gary D Smith, Parker, CO (US)

( * ) Notice: Subject to any disclaimer, the term of this patent is extended or adjusted under 35 U.S.C. 154(b) by 0 days.

(21) Appl. No.: 14/710,405

(22) Filed: May 12, 2015

(65) Prior Publication Data

US 2016/0107832 A1 Apr. 21, 2016

Related U.S. Application Data

(60) Provisional application No. 62/122,270, filed on Oct. 17, 2014.

(51) Int. Cl.

| | |
|---|---|
| ***B65D 90/00*** | (2006.01) |
| ***B65B 67/12*** | (2006.01) |
| ***B65F 1/14*** | (2006.01) |
| ***B65F 1/06*** | (2006.01) |
| ***B65D 25/16*** | (2006.01) |

(52) U.S. Cl.

CPC ..... *B65B 67/12* (2013.01); *B65B 67/1233* (2013.01); *B65B 67/1238* (2013.01); *B65D 25/16* (2013.01); *B65F 1/06* (2013.01); *B65F 1/1415* (2013.01)

(58) Field of Classification Search

CPC . B65D 90/0026; B65B 67/12; B65B 67/1238; B65B 67/1233; B65F 1/1415; B65F 1/06

USPC ..... 248/95, 99, 101, 302, 220.1, 213.2; 383/33; 220/495.1

See application file for complete search history.

(56) References Cited

U.S. PATENT DOCUMENTS

| | | | | |
|---|---|---|---|---|
| 3,130,853 A * | 4/1964 | Colthurst | B65F 1/06 | 220/495.08 |
| 4,535,911 A * | 8/1985 | Goulter | B65F 1/06 | 220/495.1 |
| 4,735,340 A * | 4/1988 | Preston | B65F 1/06 | 220/495.1 |
| 4,946,065 A * | 8/1990 | Goulter | B65D 33/06 | 220/495.1 |
| 8,458,866 B2 * | 6/2013 | Hancz | B65F 1/06 | 24/555 |
| 2004/0178240 A1 * | 9/2004 | Bauer | A45F 5/02 | 224/268 |
| 2008/0191103 A1 * | 8/2008 | Thurgar | F16B 2/22 | 248/101 |

* cited by examiner

*Primary Examiner* — Anita M King
(74) *Attorney, Agent, or Firm* — Leyendecker & Lemire LLC

(57) ABSTRACT

A bag securing device is described that fits over the corner of a corner of a produce shipping container once a shipping bag contained therein has been opened and splayed over the edges of the container. By fitting the devices to each of the four corners of the container, a shipping bag is securely held therein substantially eliminating the risk of the bag being pulled from the container when the contents, such as lettuce, are dumped there from for further processing.

18 Claims, 8 Drawing Sheets

BRACKET FOR SECURING A BAG IN A SHIPPING CONTAINER AND METHOD OF USE

RELATED APPLICATION

This application incorporates by reference and claims priority to U.S. Provisional Patent Application No. 62/122,270 entitled Polybag Security Pin (PSP) filed on Oct. 17, 2014, which has the same inventor as the present invention.

BACKGROUND

Lettuce, as well as other produce, prior to final packaging is shipped in bulk form in large disposable plastic bags contained in plastic shipping containers. For purposes of reference, a typical container is about 4 foot square. During transport the plastic bags are closed to prevent contaminants, such as airborne dust, dirt and other debris, from coming into contact with the lettuce. Once they have reached a desired processing or packing facility, the bag is opened and the mouth thereof is splayed and the open end of the bag is folded over and around the edges of the container. Tape is then used to secure the bag proximate the mouth to the outside surfaces of the container typically by tightly wrapping several layers of the tape around the outside of the container over the bag.

To proceed with processing and/or packaging, the containers are then lifted and contents thereof dumped into a receiving container at the start of a processing conveyor line. On occasion while dumping the lettuce, the bag is also pulled out of and off of the shipping container and into the receiving bin. Because the outside of the bag, which is potentially contaminated, comes into direct contact with the produce, regulations require the lettuce in the receiving bin to be treated as contaminated and considered not suitable for human consumption. This problem occurs enough that tens of millions of dollars of lettuce are lost each year. Further, the downtime required to remove the contaminated lettuce from the processing line reduces the productivity and efficiency of the conveyor line further increasing economic costs.

DETAILED DESCRIPTION

Figure 1:
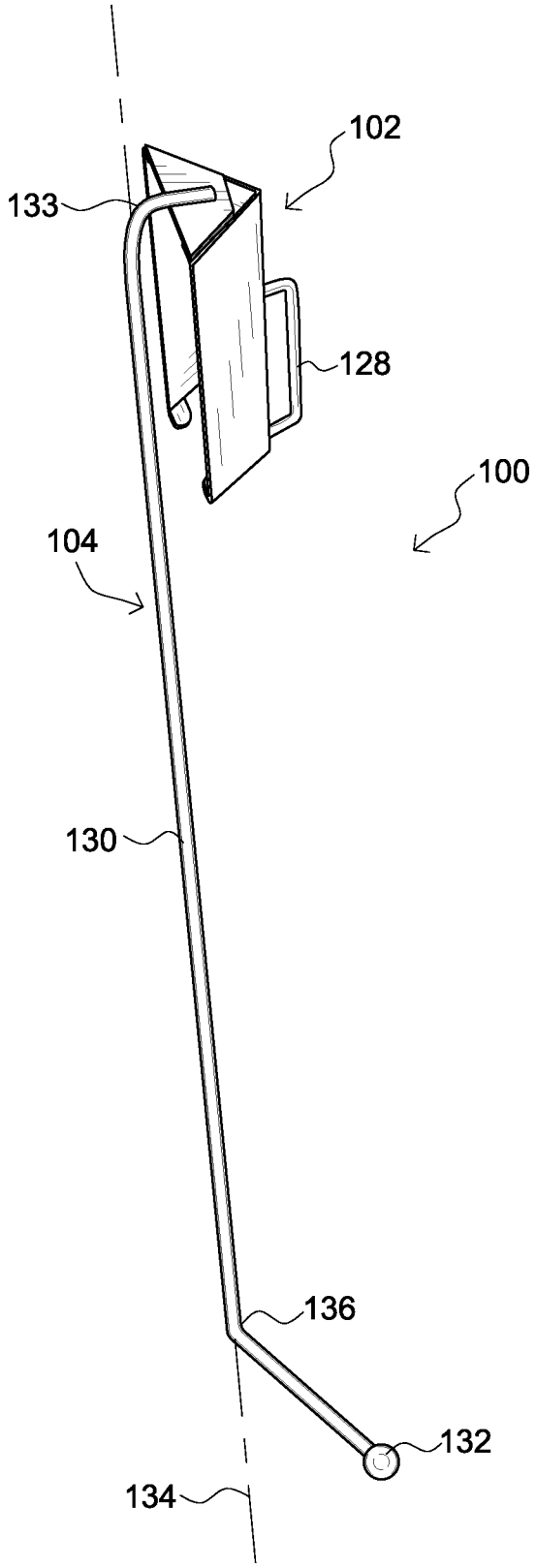
FIG. 1 is a perspective view of a device for securing a shipping bag in a shipping container according to an embodiment of the present invention.
Figure 2:
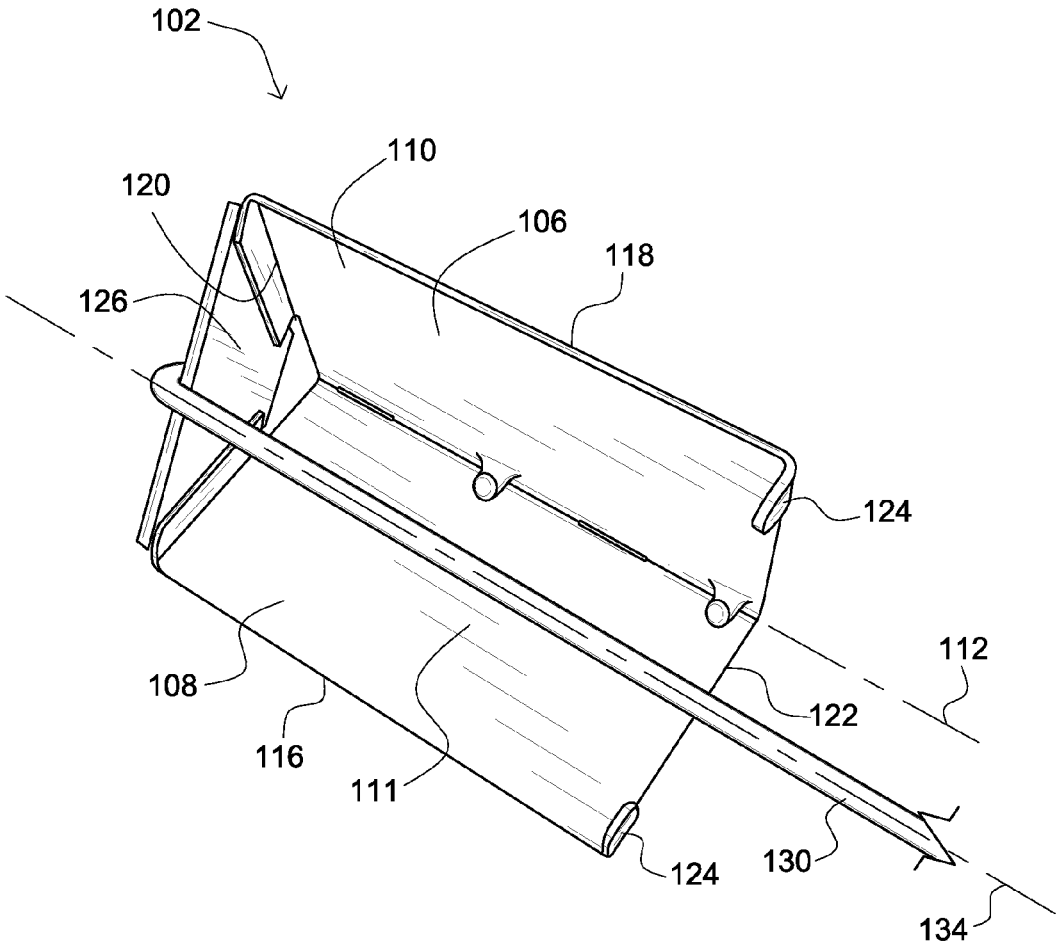
FIG. 2 is a partial perspective view of the bag securing device showing the inside of a top bracket portion according to the embodiment of the present invention.
Figure 3:
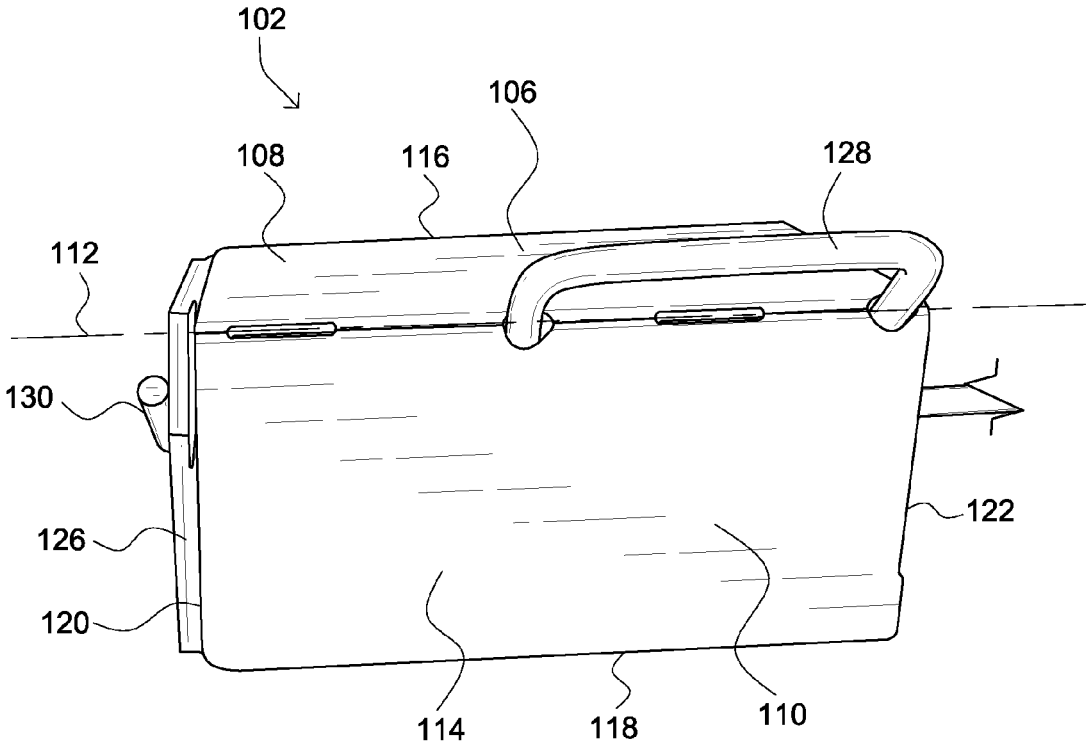
FIG. 3 is a partial perspective view of the bag securing device showing the outside of a bracket portion according to the embodiment of the present invention.
Figure 4:
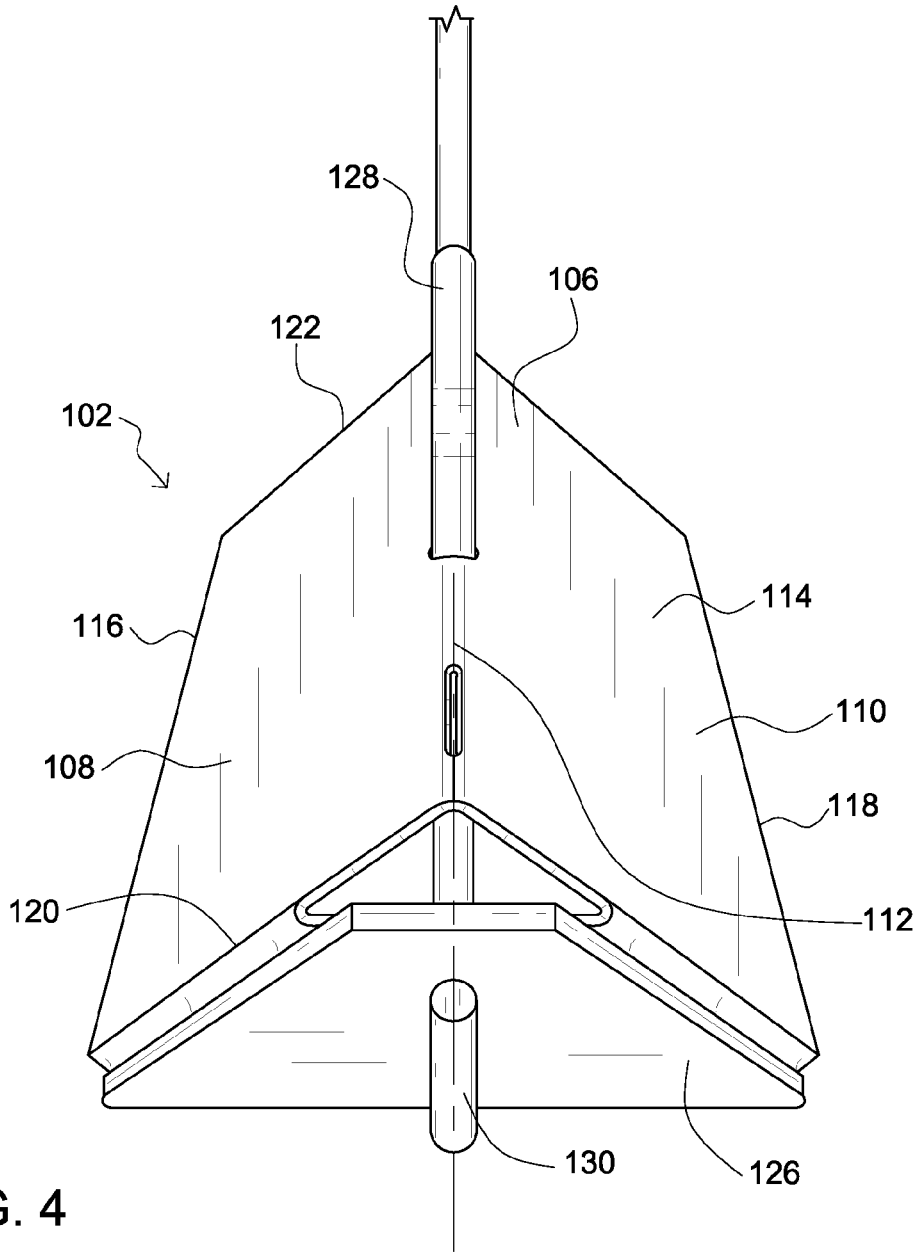
FIG. 4 is a partial perspective view of the bag securing device showing the top side of a bracket portion according to the embodiment of the present invention.
Figure 5:
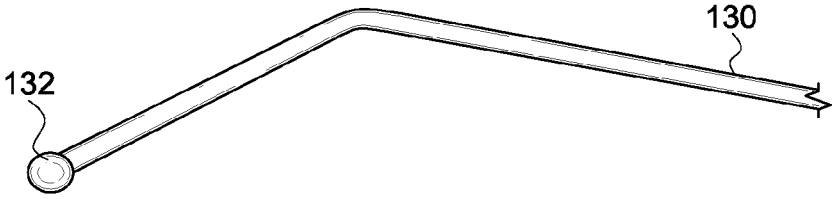
FIG. 5 is a partial perspective view of the bag securing device showing the bottom end of a pin portion according to the embodiment of the present invention.

Embodiments of the present invention comprise a bag securing device that fits over the corner of a corner of a produce shipping container once a shipping bag contained therein has been opened and splayed over the edges of the container. By fitting the devices at several locations around the edges surrounding the open side, a shipping bag is securely held therein substantially eliminating the risk of the bag being pulled from the container when the contents, such as lettuce are dumped therefrom for further processing.

Some embodiments comprise (i) a bracket section that secures the bag to the container at the open side or mouth of the container once the bag's mouth has been folded over and around the container's opening, and (ii) a pin section that has a distal end that braces up against an inside surface of the vertical sides of the container with the shipping bag intervening. The device is typically installed on the container at a corner of the container's open side. By installing similar devices on the remaining three corners an open shipping bag is fastened securely to the associated container.

In at least one embodiment, the device includes no moving parts, but rather uses the resiliency of the device and the pin section in particular to provide a bracing and retaining force that effectively locks the device in place in the corners of an associated shipping container. Design wise, this embodiment places the distal end of the pin section outwardly of the bracket section. When installed, however, with the pin deform elastically as the distal end of the pin is necessarily positioned to the inside of the bracket given the thickness of container sidewalls. The elastic deformation creates a biasing force that acts to effectively wedge the device in place. Removal from the container is as simple as simultaneously lifting up on the bracket while pulling outwardly from a provided handle. Advantageously, the use of no moving parts reduces the risk of one or more parts separating from the device, becoming lost or misplaced and rendering the device useless. Further, the lack of an active clamping device reduces the risk of malfunction or damage to the device which could also render the device unusable. As can be appreciated, however, variations and alternative embodiments are contemplated that include an active movable clamping mechanism that does incorporate one or more moving parts.

The use of a relatively thin, small diameter pin section on the inside of the container permits easy insertion of the device into a shipping container even when the container is fully loaded with lettuce or other produce. Given the diameter of a head of lettuce a small gap exists between the corner and the produce, the pin can be placed into and along this gap. For small produce that can pack into the corners more tightly, the pin can as necessary pierce the produce during insertion with relative ease. To avoid any issues with contaminating the food into which the device is coming in contact, the device is typically constructed of materials, such as stainless steel approved for direct food contact and/or coated with a food safe material, such as an FDA-approved powder coating.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

The term "unitary" as used herein means a unit, or device that once fabricated comprises a single piece that cannot be disassembled or taken apart without the use of destructive means. For instance to separate two pieces that have been welded together, the weld must be destructively cut and/or ground.

The phrase "moving parts" as used herein refers to parts and assemblies of parts designed for active movement, such as through pivots, axles, levers, plungers, threaded bolts and threaded bores and hinges. Resilient and elastic bending of rigid materials and structures, such as the flexing of a rod, does not constitute a "moving part" as the term is used and applied herein.

An Embodiment of a Device for Securing a Bag in a Shipping Container

Figure 6:
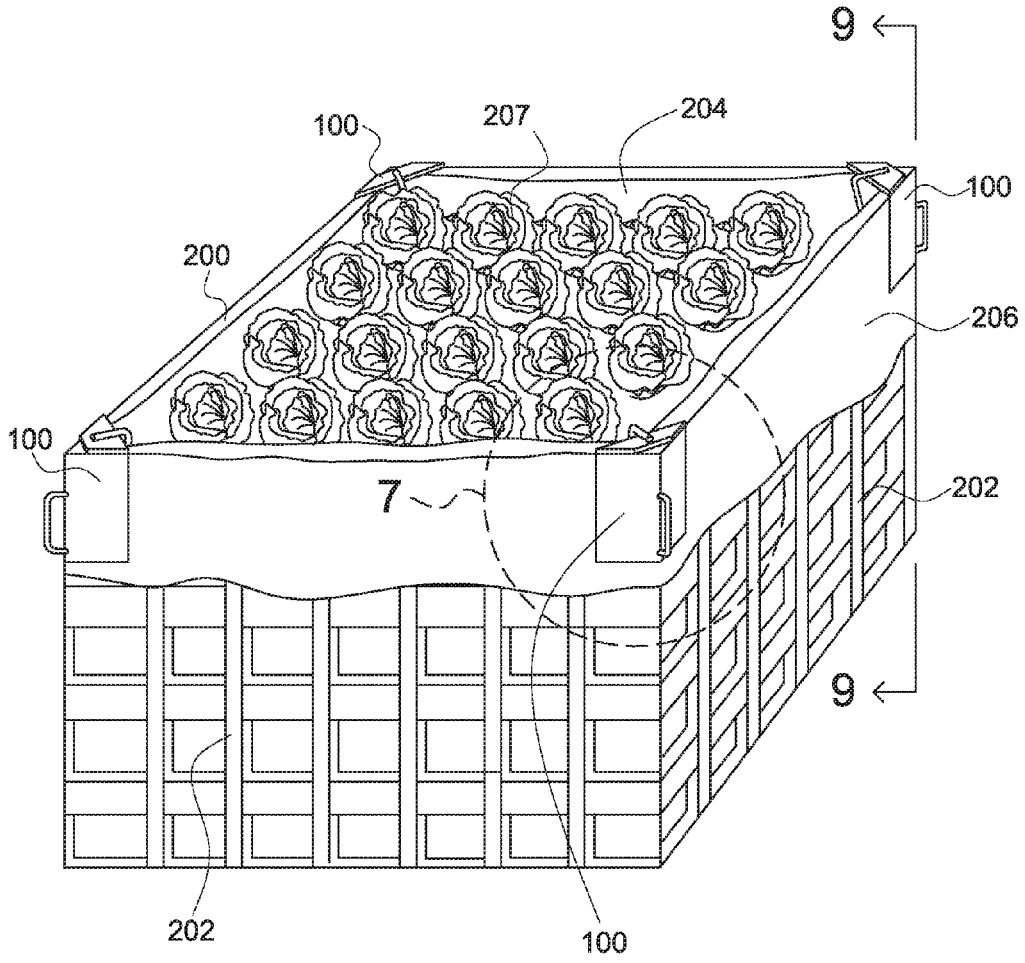
FIG. 6 is a perspective view of a shipping lined with a plastic shipping bag and filled with heads of lettuce wherein the bag is secured to the container using four bag securing devices at the container's corners according to an embodiment of the present invention.
Figure 7:
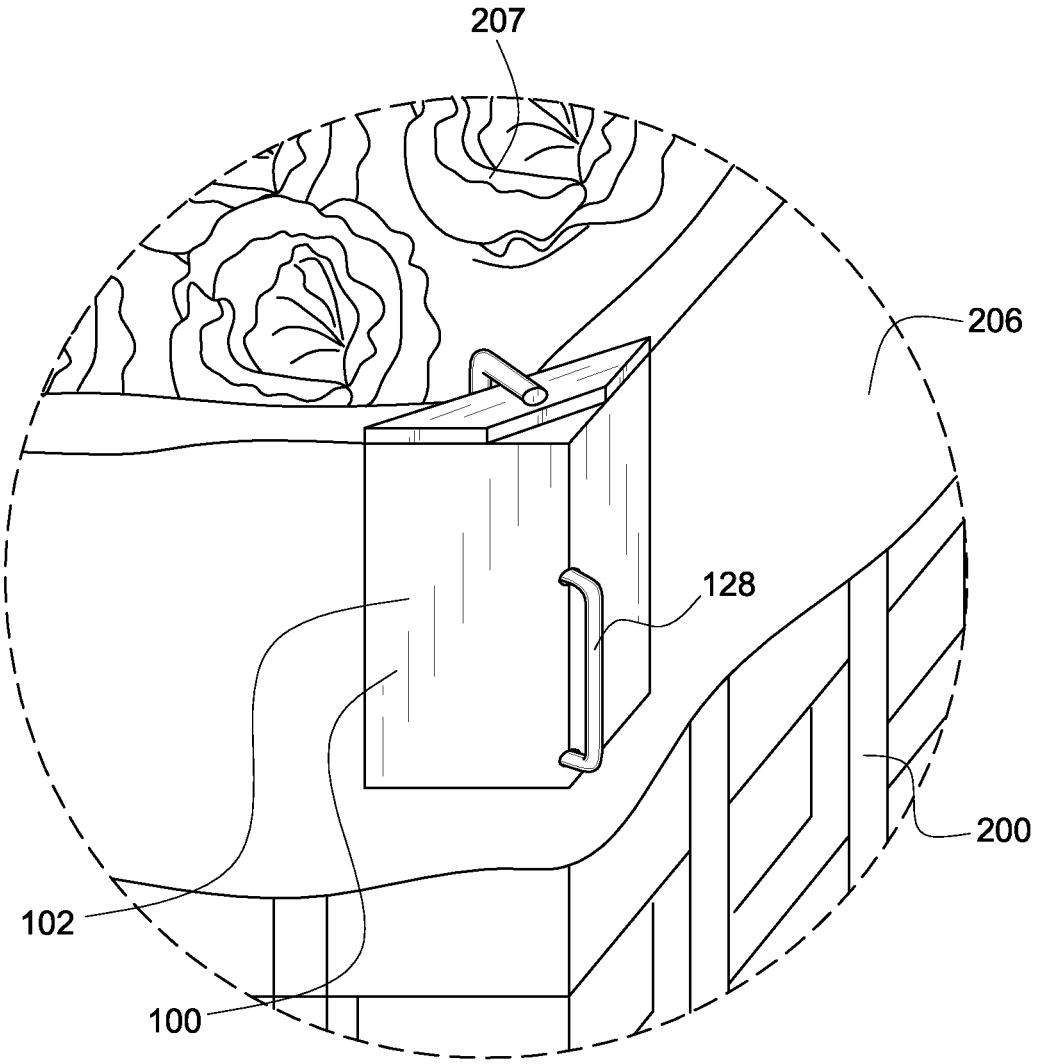
FIG. 7 is a close-up perspective view of the bag securing device installed on the corner of a shipping container according to an embodiment of the present invention.
Figure 8:
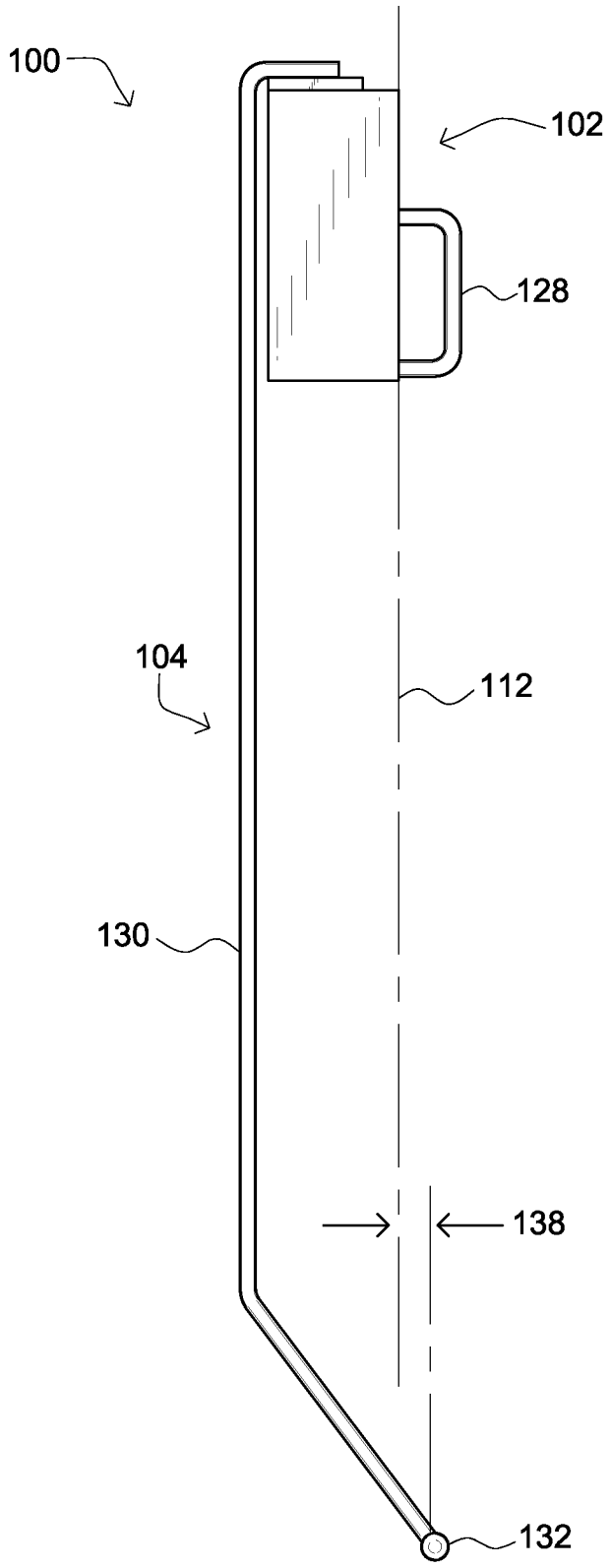
FIG. 8 is a side view of the bag securing device illustrating the horizontal positioning of the distal end of the pin section relative to the bracket section according to an embodiment of the present invention.
Figure 9:
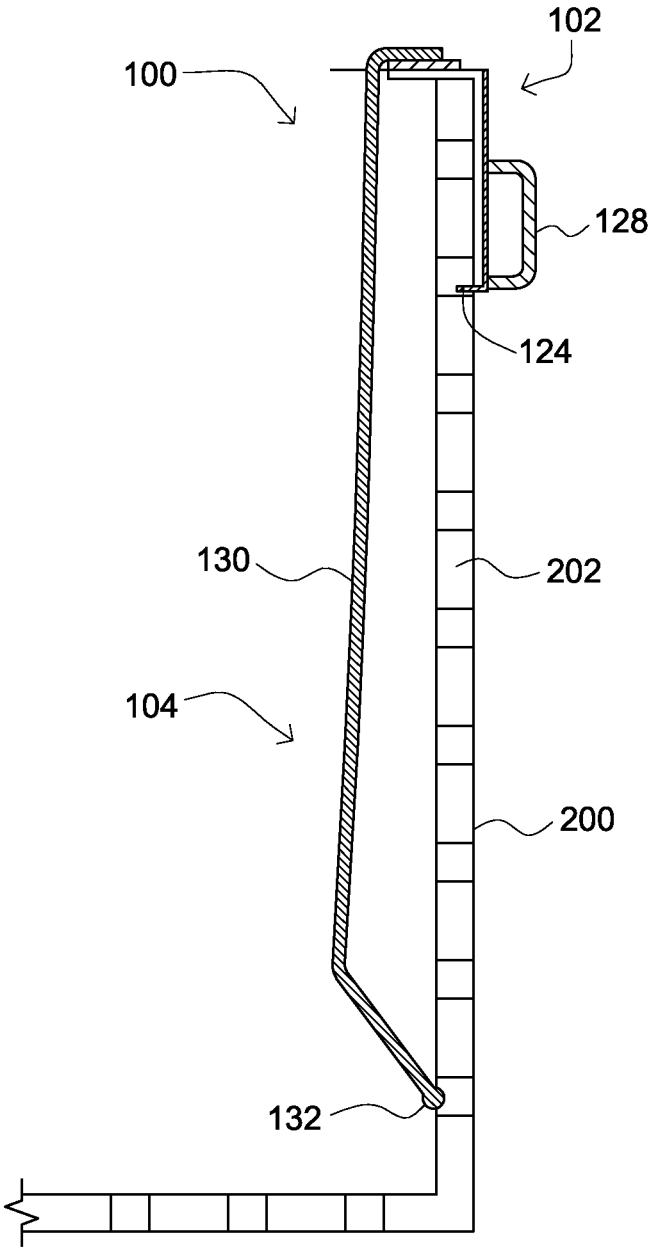
FIG. 9 is a cutaway view of a container showing the bag receiving device received therein to hold the bag in place according to an embodiment of the present invention.

FIGS. 1-5 & 8 illustrate a device for securing a shipping bag in a shipping container according to one embodiment of the present invention. FIGS. 6, 7 & 9 illustrate the embodiment or multiples of the embodiment installed in a shipping container 200 as typically utilized. Most basically, the device 100 comprises a bracket section 102 and a pin section 104 that is attached to and extends from the bracket section. The device as configured, assembled and manufactured comprises a single unitary piece with no moving components or separable parts.

The bracket section 102 is configured to fit over the outside of the shipping container 200 at a corner formed by two substantially vertical sides 202 of the container. In use, a device is installed on each of the container's four corners with each bracket section resting on adjacent top edges that together define the open top side 204 of the container as best shown in FIG. 6. In normal and intended use the container is lined with a shipping bag 206 that is filled with produce, such as heads of lettuce 207. The bag is normally closed during shipping to protect the produce from contamination, but after the arriving at an intended destination and in anticipation of further processing of the produce, the bag is opened and the mouth of the bag is splayed and folded over and around the top edges and outside surface of the vertical sides to provide easy access to the produce. As illustrated, the bag intervenes between the container and the brackets received thereon as also shown in FIG. 7.

As illustrated and pertaining to the described embodiment, the bracket 102 is secured in place on the container by way of a biasing force applied through an interaction with the pin section 104 as is discussed in greater detail below. However, in variations and other embodiments other means can be used to secure the bracket to the container 200. For instance in an alternative embodiment device (not shown), a portion of the bracket can extend over the top edges and brace against the inside surface of the vertical sides 202. The alternative embodiment device may also include a moveable mechanism, such as a screw or cam located on the portion of the bracket received on the outside of the vertical sides wall, that when actuated applies a clamping force securing the bracket to the container. It is to be appreciated the alternative device with an active clamping mechanism may or may not include the pin section 104.

The illustrated bracket section 102 is comprised primarily of a metal angle 106 having left and right arms 108 & 110 that extend orthogonally from each other at a common substantially vertical bracket intersection axis 112. The metal angle includes inwardly facing surfaces 111 and outwardly facing surfaces 114. The left arm terminates at a substantially left vertical distal edge 116, and the right arm terminates at a substantially right vertical distal edge 118. Each of the arms also includes top and bottom edges 120 & 122.

In the illustrated embodiment, the metal angle 106 further includes tabs 124 that extend inwardly from the respective bottom edge 122 of the left and right arms 108 & 110. The tabs are located proximate the intersection of each bottom edge with the respective left and right substantially vertical distal edges 116 & 118. Typically shipping containers 200 do not have solid vertical side walls but rather comprise a lattice work of sorts that allows any water to easily drain and pass therefrom. Operationally, when an embodiment includes the tabs, they extend into spaces between the tabs and brace against the bottom edge of a horizontal lattice further helping secure the device to the container.

The bracket section 102 also includes a substantially horizontal top plate 126 that spans between the top edges 120 of the left and right arms 108 & 110. The top side plate being fixedly secured to the metal angle 106 typically through welding but the connection can also comprise other fastening means including but not limited to rivets, threaded fasteners and adhesive bonding. The top plate serves two purposes in the described embodiment: (1) provide a surface on which the bracket section rests on the top edges of the container 200; and (2) provide an attachment location for the pin section 104. In variations the top plate can comprise portions of the metal angle that wherein the intersection of the applicable portion of the arms had been cut and the portions of the arm have been folded over and possibly welded or otherwise joined together to form the top plate.

Finally, the bracket section 102 includes a handle 128. The illustrated handle extends outwardly from the outwardly facing surfaces 114 of the metal angle 106 and is positioned on the substantially vertical intersection axis 112 preferably but not necessarily proximate a lower portion of the axis to provide greater leverage when installing and removing the device from a container as is described in greater detail below. The handle is typically welded to the metal angle although it can be fixedly attached by other means as well. Further, in variations the orientation and positioning of the handle or multiple handles can vary.

The pin section 104 comprises an elongated rod 130 that is fixedly attached, such as welded, to the top plate 126 of the bracket section 102 at a proximal end. A substantial portion of the rod extends generally vertically downwardly therefrom to a distal end. The distal end of the rod comprises a rounded ball 132 having an effective diameter greater than the diameter or width of the rod. The rounded ball helps eliminate any sharp edges that could come into contact with the shipping bag and puncture it. Variations are contemplated wherein the end of the rod is rounded in place of the ball. The ball is fixedly secured to the rod typically through welding although a ball that is threadably received over the distal end is also contemplated.

The elongated rod 130 typically has one or more bends along its length. Proximate its proximal end, the rod extends generally horizontally from its fixed connection with the top plate 126 along a line contained in a plane that bisects the left and right arms 108 & 110 and contains the intersection axis 112. At a horizontal location just past a plane defined by the distal vertical edges 116 & 118 of the left and right arms, the rod is bent about 90 degrees at a first bend 133 and extends substantially vertically downwardly along a rod axis 134. Generally proximate the distal end, the rod is bent at an angle of about 15-60 degrees, more preferably 20-45 degrees and most preferably 25-35 degrees at a second bend 136. The angle of the second bend affects both the ease of insertion of the pin into the container especially when filled with produce and the relative amount of biasing force applied by the pin section against the bract section 102 when installed. A smaller angle makes inserting the pin easier while a larger angle increases the magnitude of the biasing force.

In order to create the biasing force necessary to hold the device in place within a shipping container without the use of a clamping mechanism having moving parts, the elongated rod 130 is bent resiliently during installation. The biasing force pulls the bracket section 102 inwardly into greater contact with the outside surface of the container 200 as the rod tries to straighten to its unbiased position. To facilitate the necessary bending and ensure sufficient biasing force is applied, the relative position of the distal end of the pin section 104 as defined by the rounded ball 132 in the illustrated embodiment typically should be located outwardly of the intersection axis 112. With reference to FIG. 8, the end of the rounded ball is typically located a distance 138 of 0.50" to 2.0" outwardly of the intersection axis. When installed the elongated rod bends resiliently until the ball end is located generally inwardly of the intersection axis 112 (assuming the intersection axis is fully vertical which in practice it is not and is slightly angled inwardly as shown). Of important note, the actual distance 138 depends on several factors including the elastic modulus of the material comprising the elongated rod, the diameter or width of the elongated rod, and its vertical length. The foregoing range pertains to a steel rod having a vertical length of about 40" and a 0.375" diameter.

The device 100 can be comprised of any number of suitable materials including various metals and reinforced plastics. Although a portion of the bracket section 102 is referred to as a metal angle 106 variations comprised of a reinforced plastic are contemplated. Nevertheless, for purposes of durability and maximum effectiveness devices comprised of metal in general and steel in particular have been found to be particularly advantageous. Variations of the device are fabricated from steel with the various components being welded together to make a unitary single piece device without any moving parts. The steel may comprise a stainless steel alloy approved for direct contact with food, or wherein another steel alloy is utilized the steel is coated with an FDA approved coating. In at least one variation, an FDA-approved epoxy powder coat is applied to the device after it has been welded together.

The size and dimensions of the device can vary between embodiments especially when the embodiments are designed for different size containers. The industry standard shipping container used with lettuce is about 40" wide by 48" long and 40" deep. The illustrated embodiment designed specifically for use with these containers uses 4.125" steel angle and 0.5" diameter steel rod in the pin section. The bracket section is about 8.5" long and the overall length of the device inclusive of the pin section is about 40". The ball end 132 of the pin section is about 0.625" in diameter.

A Method of Using the Device for Securing a Bag in a Shipping Container

A typical produce container 200 is comprised of plastic wherein each of the vertical sides 202 are latticed and perforated to reduce the weight of the container as well as permit the container to breath and, as necessary, drain. When shipping produce and particularly lettuce 207, a large plastic shipping bag 206 is placed in the container and lines it. The bag is filled with produce. Prior to shipping, the bag is closed to protect the produce from debris, dust, dirt, oil and contaminated water. When the container arrives at its intended location for further processing of the produce and/or packaging, the container is unloaded off of the train car or truck upon which it was shipped and the bag is opened and the mouth of the bag is splayed, and folded over and around the top edges of the container and around the upper part of the outside thereof.

To secure the bag in the container 200, embodiments of the device 100 are installed in all four corners. Proximate each corner, a user inserts the ball end 132 of the pin section 104 in container and the bag 206 and guides the pin section downwardly. As the bottom of the bracket section 102 comes into contact with the top edge of the container, the user may need to pull the metal angle 106 outwardly using the handle 128 as he/she continues to push the downwardly to properly position it on the outside surface of the container. Once the top plate is in contact or near contact with the top edge, the user may need to jostle the bracket a little to ensure the tabs 124, if so equipped, are properly seated in a space between the plastic lattice work.

Once the devices 100 have been installed on all four corners of the container 200, the container can be lifted and the contents of the container dumped into a receiving bin for further processing without undue risk that the bag 206 will be pulled in with the produce potentially contaminating it. After the produce has been dumped, the devices are removed by a user typically by pulling outwardly on bracket handle 128 while lifting upwardly. As necessary the units can be washed down as necessary before being inserted into another container.

Variations and Other Embodiments

The various embodiments, methods and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

The embodiments and methods described herein pertain primarily to the use of the device in securing a shipping bag in a shipping container configured or designated to transport produce, and specifically lettuce. It is appreciated embodiments of the device can also be used in bins for shipping non-produce products as well and as applicable.

In other embodiments that utilize an active clamping mechanism, the pin section can be omitted from the device as it is not required to provide a biasing force to secure the bracket section in place. However, a pin section may be used in some variation, perhaps without the second bend, to help keep the bag in the container as the container's contents are being dumped. Additionally, embodiments are contemplated wherein the bracket section does not use a metal angle and is configured to attach to the sides of the container between the corners. Tabs extending into the lattice work openings can be employed to keep this variation of the device properly positioned and aligned. Finally, variations are contemplated wherein the device is not unitary but comprises separate and distinct parts or components that are not fixedly secured together, such as by welding, adhesive bonding or riveting.

I claim:

1. A bag securing device for securing a shipping bag lining the interior of a shipping container to shipping container when a mouth of the bag has been folded over and around the edges of an open top side of the shipping container, the device comprising:

a bracket section, the bracket section being configured to attach over and against a corner of the open top side wherein the corner and top side are covered by the plastic shipping bag;

a pin section, the pin section comprising an elongated rod, the rod being attached to the bracket section at a proximal end with a substantial portion of the rod extending generally vertically downwardly therefrom to a distal end; and wherein the bracket section comprises an elongated metal angle portion having left and right arms extending orthogonally from a common substantially vertical bracket intersection axis defining inwardly facing surfaces and outwardly facing surfaces of the metal angle, each arm terminating at a respective left or right substantially vertical distal edge.

2. The bag securing device of claim 1, wherein the device comprises a single unitary piece.

3. The bag securing device of claim 1, including at least one handle, the handle extending outwardly from the outwardly facing surfaces.

4. The bag securing device of claim 3, wherein the handle is positioned on the substantially vertical intersection axis.

5. The bag securing device of claim 1, wherein the device is substantially comprised of stainless steel.

6. The bag securing device of claim 1, wherein the device is substantially comprised of steel and has a FDA-approved coating applied thereto.

7. The bag securing device of claim 6, wherein the FDA-approved coating is an epoxy powdercoat.

8. The bag securing device of claim 1, wherein the metal angle further includes left and right tabs extending inwardly from a respective left and right substantially horizontal bottom edge of the respective left and right arms, the tabs being located proximate the intersection of the bottom edges with the respective left and right substantially vertical distal edges.

9. The bag securing device of claim 1, wherein the device has no moving parts.

10. The bag securing device of claim 1, wherein a substantially horizontal top side plate spans between a left and right top edge of the respective left and right arms, the top side plate being fixedly secured to the metal angle.

11. The bag securing device of claim 10, wherein the top side plate is welded to the metal angle.

12. The bag securing device of claim 10, wherein the rod has one or more bends, the rod extending generally horizontally from a fixed connection with the top plate, the rod being bent about 90 degrees at a first bend of the one or more bends at and extending vertically downwardly along a rod axis, the rod axis being located proximate a plane defined by the distal edges of the left and right arms.

13. The bag securing device of claim 12, wherein the rod is bent at a second bend at an angle of about 20-60 degrees generally proximate the distal end of the rod.

14. The bag securing device of claim 13, wherein the bent portion extends substantially along a plane defined by the bracket intersection axis and the rod axis, the distal end of the pin section being located horizontally outward of the intersection axis.

15. The bag securing device of claim 13, wherein the distal end of the pin section being located 0.5-2.0" outward of the intersection axis.

16. A method of using the bag securing device of claim 10, the method comprising:

providing the bag securing device;

providing the shipping container, the shipping container being lined with the shipping bag and the mouth of the shipping bag being folded over and around the top edges of the shipping container's open side;

at a corner of the shipping container formed by two intersection vertical sides thereof, inserting the pin section into the shipping container through the open side;

positioning the bracket section against the shipping bag on the outside of the container at the corner wherein the inwardly facing surfaces of the metal angle is butted up against an outside surface of the shipping container at the corner with the shipping bag at least partially intervening and the top plate is butted up against the top edges of the open side with the shipping bag intervening; and positioning the distal end of the pin section against an inside surface of the container at the intersection with the shipping bag intervening.

17. A bag securing device for securing a shipping bag lining the interior of a shipping container to shipping container when a mouth of the bag has been folded over and around the edges of an open top side of the shipping container, the device comprising:

a bracket section, the bracket section being configured to attach over and against a corner of the open top side wherein the corner and top side are covered by the plastic shipping bag;

a pin section, the pin section comprising an elongated rod, the rod being attached to the bracket section at a proximal end with a substantial portion of the rod extending generally vertically downwardly therefrom to a distal end; and wherein the distal end of the rod comprises a rounded ball having an effective diameter greater than the diameter or width of the rod.

18. A method of using a bag securing device for securing a shipping bag lining the interior of a shipping container to shipping container when a mouth of the bag has been folded over and around the edges of an open top side of the shipping container, the method comprising:

providing the bag securing device, the device comprising (i) a bracket section, the bracket section being configured to attach over and against a corner of the open top side wherein the corner and top side are covered by the plastic shipping bag, and (ii) a pin section, the pin section comprising an elongated rod, the rod being attached to the bracket section at a proximal end with a substantial portion of the rod extending generally vertically downwardly therefrom to a distal end;

providing the shipping container, the shipping container being lined with the shipping bag and the mouth of the shipping bag being folded over and around the top edges of the shipping container's open side;

at a corner of the shipping container formed by two intersection vertical sides thereof, inserting the pin section into the shipping container through the open side;

positioning the bracket section against the shipping bag on the outside of the container at the corner; and positioning the distal end of the pin section against an inside surface of the container at the intersection with the shipping bag intervening.

* * * * *